US010486847B1

(12) United States Patent
Soehnlen et al.

(10) Patent No.: US 10,486,847 B1
(45) Date of Patent: Nov. 26, 2019

(54) BOTTLE WITH CENTER POUR OPENING, CONTOURED HANDLE, AND CONTOURED PROFILE FOR INTERLOCKING DURING STACKING/TRANSPORT

(71) Applicant: CREATIVE EDGE DESIGN GROUP, LTD., Canton, OH (US)

(72) Inventors: Gregory M. Soehnlen, Canton, OH (US); Alexander Campana, Lorain, OH (US)

(73) Assignee: CREATIVE EDGE DESIGN GROUP, LTD., Canton, OH (US)

( * ) Notice: Subject to any disclaimer, the term of this patent is extended or adjusted under 35 U.S.C. 154(b) by 22 days.

(21) Appl. No.: 15/095,843

(22) Filed: Apr. 11, 2016

Related U.S. Application Data

(60) Provisional application No. 62/145,183, filed on Apr. 9, 2015.

(51) Int. Cl.

| | |
|---|---|
| ***B65D 1/02*** | (2006.01) |
| ***B65D 21/02*** | (2006.01) |
| ***B65D 23/10*** | (2006.01) |
| ***B65D 41/02*** | (2006.01) |

(52) U.S. Cl.
CPC ..... *B65D 1/0223* (2013.01); *B65D 21/0202* (2013.01); *B65D 21/0209* (2013.01); *B65D 21/0219* (2013.01); *B65D 21/0231* (2013.01); *B65D 23/102* (2013.01); *B65D 41/02* (2013.01)

(58) Field of Classification Search
CPC ..... B65D 1/0223; B65D 21/0202; B65D 21/0209; B65D 21/0219; B65D 21/0231; B65D 23/102
USPC ..... 220/23.4, 23.2
See application file for complete search history.

(56) References Cited

U.S. PATENT DOCUMENTS

| | | | | |
|---|---|---|---|---|
| 3,369,658 | A * | 2/1968 | Hasselmann | B65D 21/0202 206/430 |
| D331,703 | S * | 12/1992 | Seguin | D9/543 |
| 5,392,937 | A * | 2/1995 | Prevot | B65D 1/0223 215/396 |
| D509,144 | S * | 9/2005 | Snyder | D9/522 |
| 7,874,442 | B2 * | 1/2011 | Nievierowski | B65D 1/0223 215/382 |
| 8,746,453 | B1 * | 6/2014 | Hall | B65D 21/0202 206/504 |
| 2004/0206718 | A1 * | 10/2004 | Wetherell, Jr. | B65D 1/0223 215/10 |
| 2007/0102320 | A1 * | 5/2007 | Van Der Krogt | B65D 21/0202 206/581 |

(Continued)

*Primary Examiner* — Jeffrey R Allen
*Assistant Examiner* — Jennifer Castriotta
(74) *Attorney, Agent, or Firm* — Fay Sharpe LLP

(57) ABSTRACT

A container for fluid product includes a one piece body having first, second, third, and fourth sidewalls, an upper surface and a lower surface. Two of the sidewalls have non-linear, parallel conformations that each include a convex surface portion that merges into an adjacent concave surface portion for abutting engagement between adjacent containers and limit sliding movement of the abutting stacked containers. The upper and lower surfaces have a center pour opening and a recessed region, respectively, which cooperate to limit sliding movement of adjacent stacked containers relative to one another. A handle cylindrical portion is dimensioned to conform to a generally C-shape contour formed by a user's thumb and index finger.

13 Claims, 13 Drawing Sheets

(56) References Cited

U.S. PATENT DOCUMENTS

| | | | | |
|---|---|---|---|---|
| 2008/0029475 | A1* | 2/2008 | Scarola | B65D 23/102<br>215/398 |
| 2010/0294691 | A1* | 11/2010 | Sadler | B65D 5/4216<br>206/459.5 |
| 2012/0325718 | A1* | 12/2012 | Larsen | B65D 21/0202<br>206/515 |
| 2016/0340079 | A1* | 11/2016 | Le Guen | B65D 21/0202 |

* cited by examiner

BOTTLE WITH CENTER POUR OPENING, CONTOURED HANDLE, AND CONTOURED PROFILE FOR INTERLOCKING DURING STACKING/TRANSPORT

This application claims the priority benefit of U.S. provisional application Ser. No. 62/145,183, filed Apr. 9, 2015, the entire disclosure of which is expressly incorporated herein by reference.

BACKGROUND

The present disclosure relates to fluid containers (also commonly referred to as bottles), and more particularly to bottles that, for example, are typically plastic and blow molded as a one-piece, unitary body having an opening through which fluid contents are introduced into and poured from the bottle.

Consumers have a comfort level with a bottle that has a center pour opening formed therein. Advantageously, such a bottle is also adaptable to a traditional filler, for example, of the type commonly used in the dairy industry. It is well-known that milk bottles have conventionally used a center pour opening dating back to glass bottle designs, and that the center pour opening design has been carried through into present-day plastic milk bottles that are widely used in the industry.

In a continued attempt to reduce costs associated with packaging, delivery, etc., a need exists for a bottle design that has desired attributes not associated with the conventional packaging of individual containers/bottles into cases (where cases are used to carry the stacking forces or load, rather than modifying the bottle to itself carry and transfer load), and a large number of bottles can be easily stacked (such as on pallets), that potentially eliminates use of slip sheets, and that still mimics the comfort and feel associated with a center pour bottle. Still other desired features may include a cap that has a breakaway tamper evident band, elimination of a foil seal, the ability to fill on a traditional filler, provision for enlarged surfaces on the bottle to maximize the amount of information that may be conveyed to the consumer, a desire to interlock adjacent bottles, an ergonomic handle, and the ability to palletize filled bottles to take advantage of reduced shipping costs.

SUMMARY

A new container for fluid product satisfies one or more of the needs identified above.

In one embodiment, the container includes a one piece body having first, second, third, and fourth sidewalls, an upper surface and a lower surface, the first and third sidewalls separated by the second and fourth sidewalls, the second and fourth sidewalls having non-planar, parallel conformations that each include a convex surface portion that merges into an adjacent concave surface portion.

The container further includes a handle formed at least in part by a cylindrical portion that is dimensioned to conform to a generally C-shaped contour formed by a user's thumb and index finger when the fingers of a user's hand are stretched and shaped over a virtual hemispherical surface.

A circumferential region of the cylindrical portion of the handle merges tangentially into the fourth sidewall.

The handle further includes recesses or depressions formed in the first and third sidewalls that are spaced inwardly from the fourth sidewall.

The handle may be a no pass structure.

The convex first portion and the concave second portion on the second sidewall are opposite from the concave first portion and the convex second portion on the fourth sidewall, respectively, whereby adjacent, like containers interlock against relative sliding movement in a direction oriented between the upper and lower surfaces, i.e., the convex first portion of the second sidewall of a first container mates with the concave first portion of the fourth sidewall of an adjacent second container, and the concave second portion of the second sidewall of the first container mates with the convex second portion of the fourth sidewall of the second container.

The recessed region in the lower surface is dimensioned to at least partially receive a center pour opening or cap of the upper surface of an adjacent like container whereby abutting upper and lower surfaces of adjacent, like containers interlock against relative sliding movement in a direction oriented between the second and fourth sidewalls.

Adjacent containers may be arranged in layers and layers stacked one atop another by laying individual containers on either the first and third sidewalls where at least two laterally adjacent containers interlock along abutting second and fourth sidewalls, respectively, and at least two longitudinally adjacent containers interlock along the upper and lower surfaces.

At least some of the individual containers in contiguous layers of stacked containers are oriented 90 degrees relative to one another.

The containers in a stacked array are each pressurized.

The upper surface is laterally offset from the bottom surface of an individual container.

The circumferential region of the cylindrical portion of the handle that tangentially merges into the fourth sidewall is located in that portion of the fourth sidewall that has a convex contour.

The handle is formed at least in part by a cylindrical portion that is dimensioned to conform to a generally C-shape contour formed by a user's thumb and index finger when the fingers of a user's hand are stretched and shaped over a virtual hemispherical surface.

Benefits are provided by a bottle that has a center pour opening formed therein, and therefore adaptable to be filled on a traditional filler, while still offering the benefits of stackability without the use of cases for purposes of shipping.

Another benefit is the ability to use a cap that has a breakaway tamper evident band and eliminates use of a foil seal.

Another advantage resides in the enlarged surfaces provided on the bottle to maximize the amount of information that may be conveyed to the consumer.

Still another advantage is associated with the ability to interlock adjacent bottles in a layer of a stacked array.

Yet another benefit is found in the provision of an ergonomic handle.

Still another benefit is associated with elimination of the cardboard or corrugate slip layer oftentimes used in connection with stacked products which reduces, cost, reduces waste, reduces associated handling and thereby reduces labor costs, and eliminates issues encountered in the prior art where the slip layer becomes moist or wet and loses its strength.

A still further advantage results from a shorter unbraced length as a result of orienting the containers on their sides when the containers are stacked in layers one atop another.

Yet another advantage is the low weight to volume ratio (e.g., 96 ounce container uses only 90 grams of PET—less than 0.94 g/oz) which is approximately one-third that of other plastic containers used in the market.

Other benefits and advantages of the present disclosure will become more apparent from reading and understanding the following detailed description

DETAILED DESCRIPTION

Figure 1:
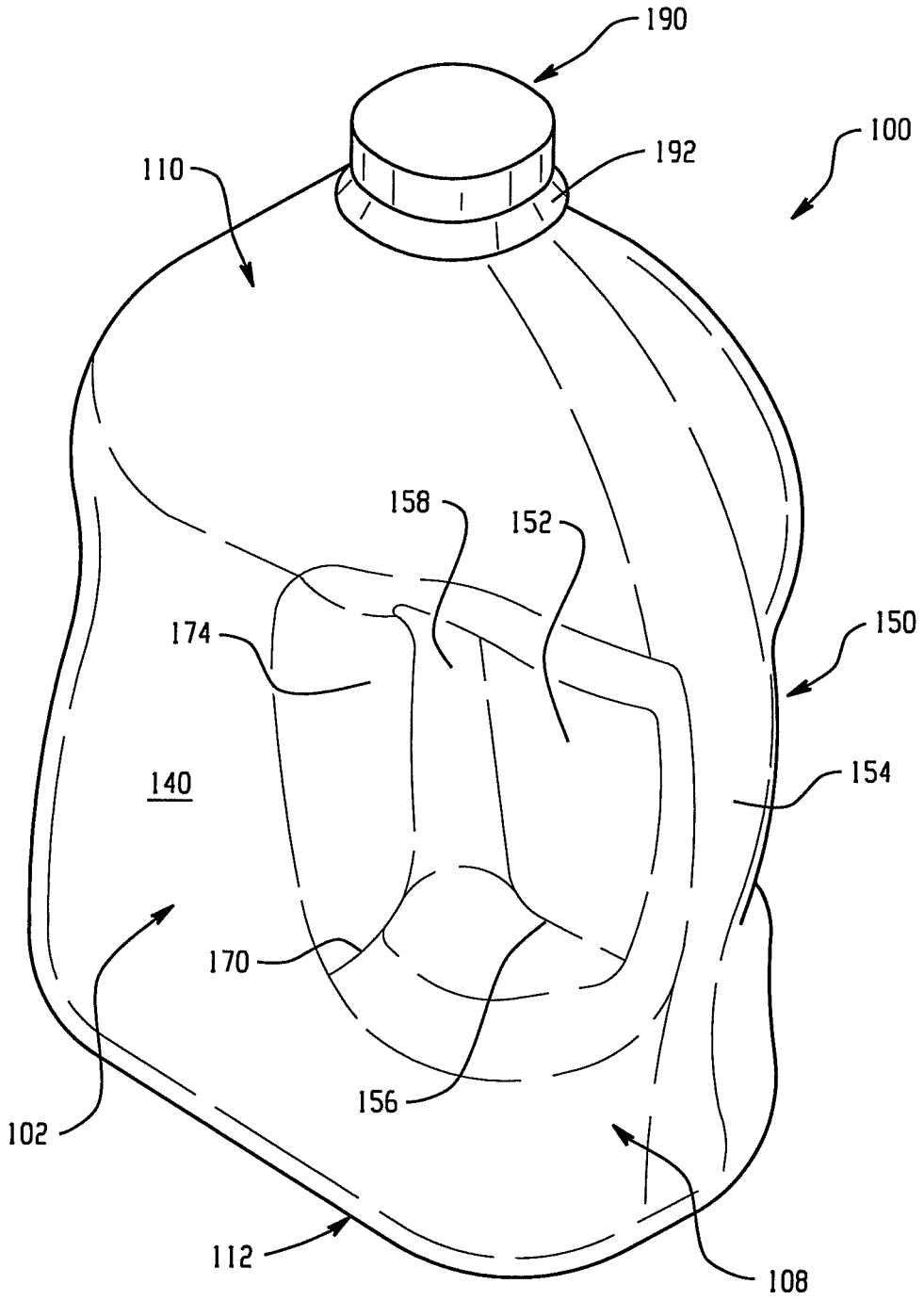
FIG. 1 is a perspective view of the new bottle of the present disclosure with a cap received thereon.

Turning initially to FIGS. 1-6, there is shown a bottle 100 that is preferably a unitary, one-piece body having first, second, third, and fourth sidewalls or sidewall portions 102, 104, 106, 108 and a first, upper wall or surface 110 and a second, lower wall or surface 112. The first and third sidewalls 102, 106 are separated by the second and fourth sidewalls 104, 108 (sometimes referred to herein as the front and rear sidewalls). The second and fourth sidewalls 104, 108 have non-planar, substantially parallel conformations as perhaps best illustrated in FIGS. 2 and 3. The conformation of the second sidewall 104 includes a convex surface portion 120 that merges into an adjacent concave surface portion 122. More particularly, the convex surface portion 120 on the second sidewall 104 includes a first convex surface portion 120*a* and a second convex surface portion 120*b*. The concave surface portion 122 interconnects the spaced apart convex surface portions 120*a*, 120*b* in a generally smoothly contoured, reverse-curved surface or S-curve conformation. The first convex surface portion 120*a* also smoothly merges into the bottom surface 112. The concave surface portion 122 is located approximately mid-height of the overall height of the bottle 100, and the second convex surface portion 120*b* of the second sidewall smoothly merges into the upper surface 110.

The fourth sidewall 108 includes a convex surface portion 124 and a concave surface portion 126. As illustrated, the convex surface portion 124 of the fourth sidewall 108 includes a first convex surface portion 124*a* and a second convex surface portion 124*b*. The concave surface portion 126 interconnects the spaced apart convex surface portions 124*a*, 124*b* in a generally smoothly contoured, reverse-curved surface or S-curve conformation. The first convex surface portion 124*a* smoothly merges into the bottom surface 112. The concave surface portion 126 of the fourth sidewall 108 is located below the mid-height of the overall height of the bottle 100, and the second convex surface portion 124*b* smoothly merges into the upper surface 110.

Figure 2:
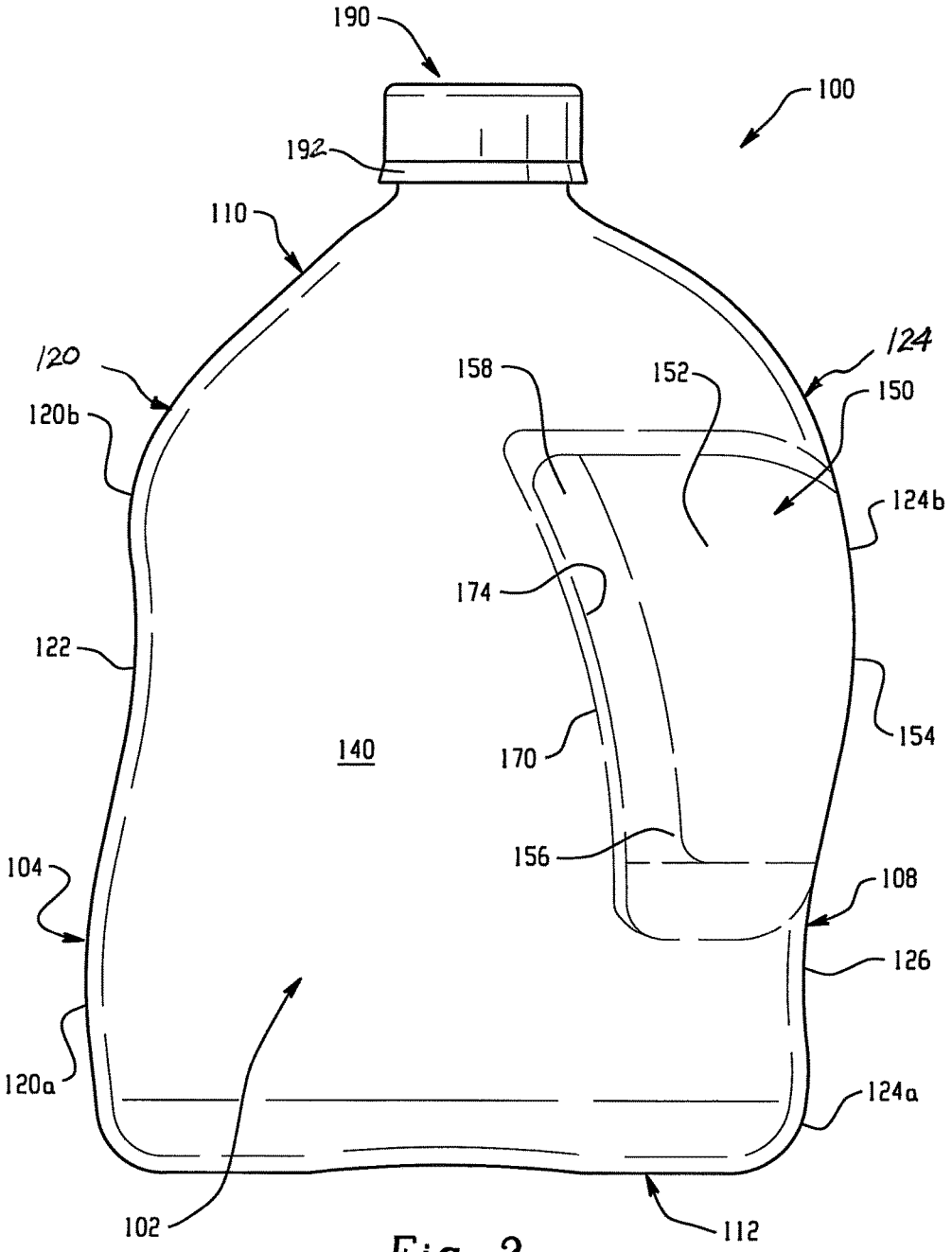
FIG. 2 is an elevational view of the bottle of FIG. 1.
Figure 3:
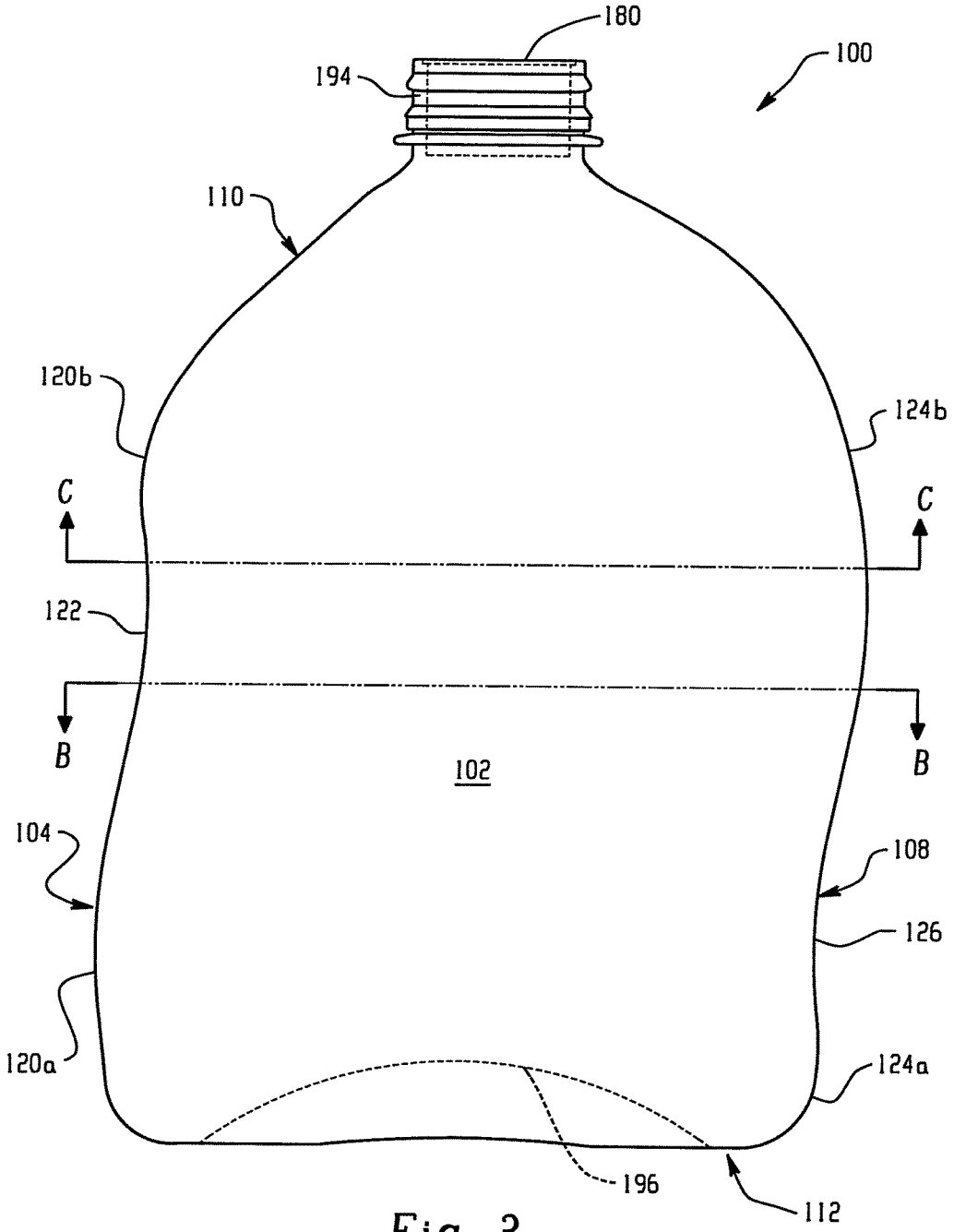
FIG. 3 is an elevational view of the perimeter contour of the bottle of FIGS. 1-2 with the cap removed.
Figure 5:
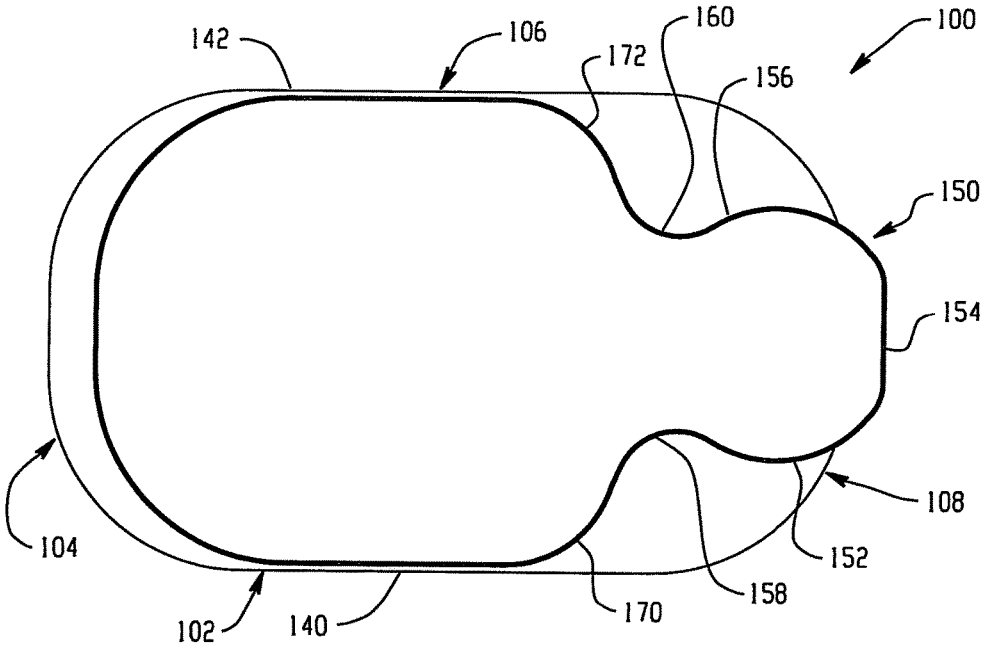
FIG. 5 is a cross-sectional view of the bottle of FIGS. 1-2 taken generally along the lines B-B of FIG. 3.
Figure 6:
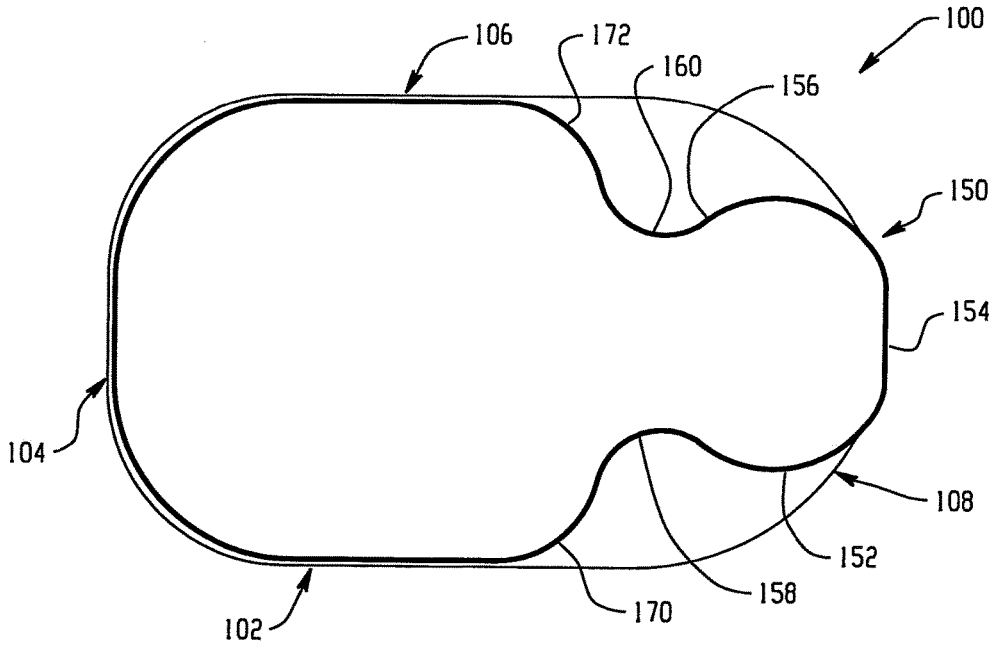
FIG. 6 is a cross-sectional view of the bottle of FIGS. 1-2 taken generally along the lines C-C of FIG. 3.

As is perhaps most apparent in FIGS. 2 and 3, and the cross-sectional views of FIGS. 5 and 6, an upper portion of the bottle 100 is laterally offset relative to a lower portion of the bottle. More particularly, the portions of the bottle 100 that extend above the mid-height of the bottle, for example associated with the second convex portion 120*b* of the second sidewall 104 and the second convex portion 124*b* of the fourth sidewall 108, are shifted rearwardly (rightwardly as shown in FIGS. 2, 3, 5, and 6) relative to the lower portion of the bottle generally defined by the first convex portion 120*a* of the second sidewall and the first convex surface portion 124*a* of the fourth sidewall 108. As a result, the second and fourth sidewalls 104, 108 can be described as having non-planar, parallel conformations where each of the second and fourth sidewalls includes a convex surface portion that merges into an adjacent concave surface portion, and in each instance includes first and second convex surface portions that merge into opposite ends of the concave surface portion, respectively.

Figure 4:
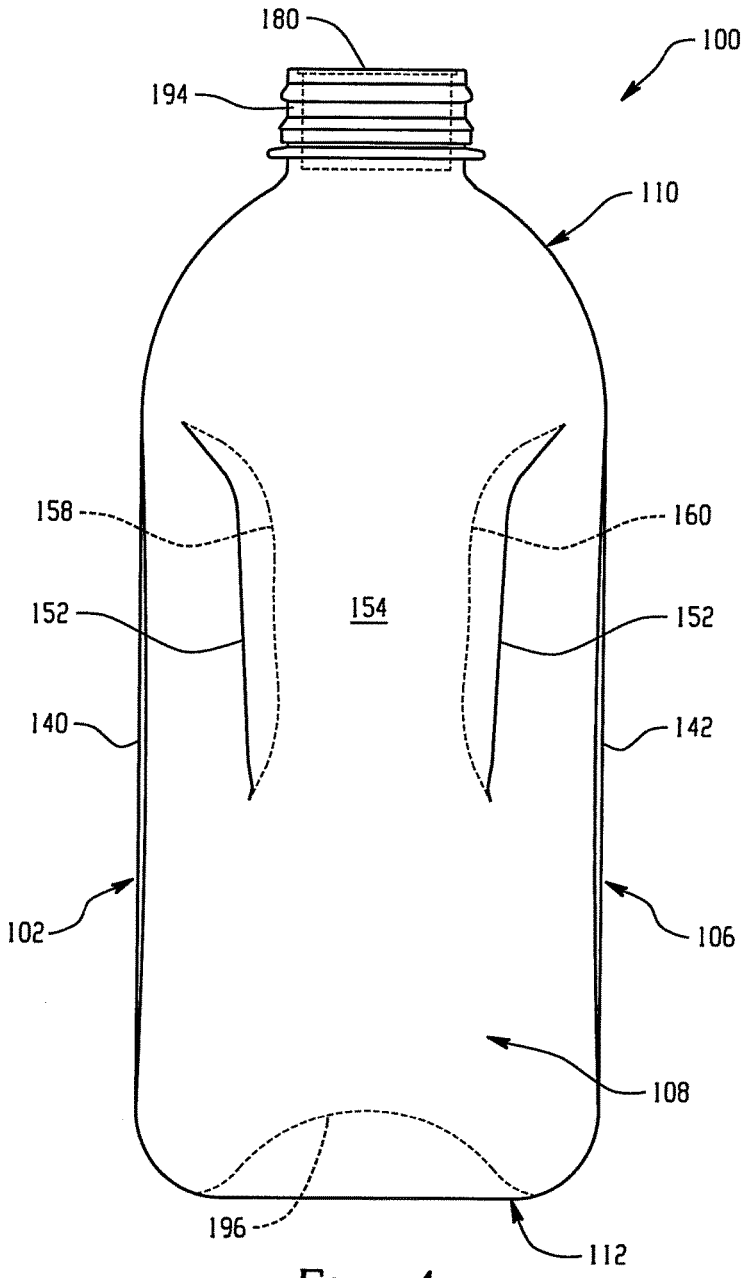
FIG. 4 is an elevational view of the right hand side of the bottle of FIGS. 1-2.

The contours of the first and third sidewalls 102, 106 are more particularly evident in FIGS. 4-6. The first and third sidewalls 102, 106 have large planar regions 140, 142, respectively, over substantial portions thereof. The planar regions 140, 142 smoothly merge into the second and fourth sidewalls 104, 108 of the bottle structure, particularly along the upper and lower portions of the sidewalls. An ergonomic handle 150 is formed partially in the first and third sidewalls 102, 106, and also along the fourth sidewall 108. A main portion of the handle 150 has a substantially cylindrical conformation 152 and a portion 154 of the cylindrical conformation merges into the fourth sidewall 108. At a diametrical portion 156 of the handle 150 opposite the portion 154 that merges into the fourth sidewall, the first and third sidewalls 102, 106 have recessed or depressed regions 158, 160, respectively, that extend inwardly from the substantially planar regions 140, 142, respectively, toward one another. The depressed regions 158, 160 are formed in the first and third sidewalls 102, 106 and are spaced inwardly (i.e., toward the second sidewall 104) from the fourth sidewall 108. It is contemplated that in a preferred arrangement, the depressed regions 158, 160 are generally parallel to one another, and form a "no pass structure", i.e., no through opening is formed inwardly of the diametrical portion 156 of the generally cylindrical conformation 152 of the handle 150. The circumferential region 154 of the cylindrical portion 152 of the handle 150 that tangentially merges into the fourth sidewall 108 is located in that portion of the fourth sidewall that has a convex contour 124*b*.

The unique configuration or shape of the handle 150 is dimensioned to conform to a generally C-shaped contour formed by a user's thumb and index finger when the fingers of a user's hand are stretched and shaped over a virtual hemispherical surface. Thus, the thumb and index finger (as well as the remaining fingers) are received over the cylindrical conformation portion 152 of the handle 150. The palm of the user's hand is received over the circumferential region 154 of the handle, and likewise conforms to the convex contour 124*b* of the handle defined along the fourth sidewall 108. The fingers and thumb of the user grip the handle 150 along the cylindrical conformation 152 disposed in each of the first and third sidewalls 140, 142, respectively (or in the third and first sidewalls 142, 140, respectively,—depending on whether the user grips the handle 150 with the right or left hand). Interconnecting portions 170, 172 of the first and third sidewalls 102, 104 each have a compound, curvilinear conformation in a generally horizontal plane (FIGS. 1-2, and particularly FIGS. 5-6) where the sidewall curves outwardly from the respective depressed regions 158, 160 toward the second sidewall 104 where the curvilinear conformation smoothly merges into the large planar regions 140, 142, respectively. In addition, the compound curvilinear conformation 170, 172 includes a curve 174 extending in a generally vertical direction (FIGS. 1-2) that extends generally parallel to the tangential region 154 of the handle that is formed in the fourth sidewall 108.

The upper wall 110 has an arch shape where the respective sidewalls 102, 104, 106, 108 merge together. The upper wall includes an opening 180 located centrally therein. This is advantageous for at least a couple of reasons. First, the central opening 180 can be used with many existing fillers that already are commercially installed and widely used in the industry. Second, the central opening 180 is a pour location that consumers are accustomed to and have used for a long period of time. The consumer is comfortable with how fluid pours from the opening 180, and need not re-train themselves to grow accustomed to other locations of the opening when pouring contents from the bottle 100.

In FIGS. 1 and 2, the central opening 180 is shown with a cap 190 received thereon. The cap 190 may be a standard construction and may include, for example, a breakaway tamper evident portion 192. It will be appreciated that the cap 190 has internal threads or thread portions (not shown) that cooperate with corresponding threads or thread portions 194 (FIGS. 3-4) provided on the exterior of the bottle 100 around the opening 180. Once the bottle 100 has been filled through the opening 180, the cap 190 is received over the opening to close the opening and may be used with or without, for example, a gasket liner for sealing the opening until the user removes the cap from the bottle. The lower wall 112 includes a central recess 196 (shown here in FIGS. 3, 4, 7, and 8) that extends upwardly (in the general shaped of an arch) from the remainder of the perimeter of the lower wall. The central recess 196 is dimensioned for at least partial receipt of the cap 190 of an adjacent bottle 100 when the bottle is stacked on its side as will be described further below.

Figure 9:
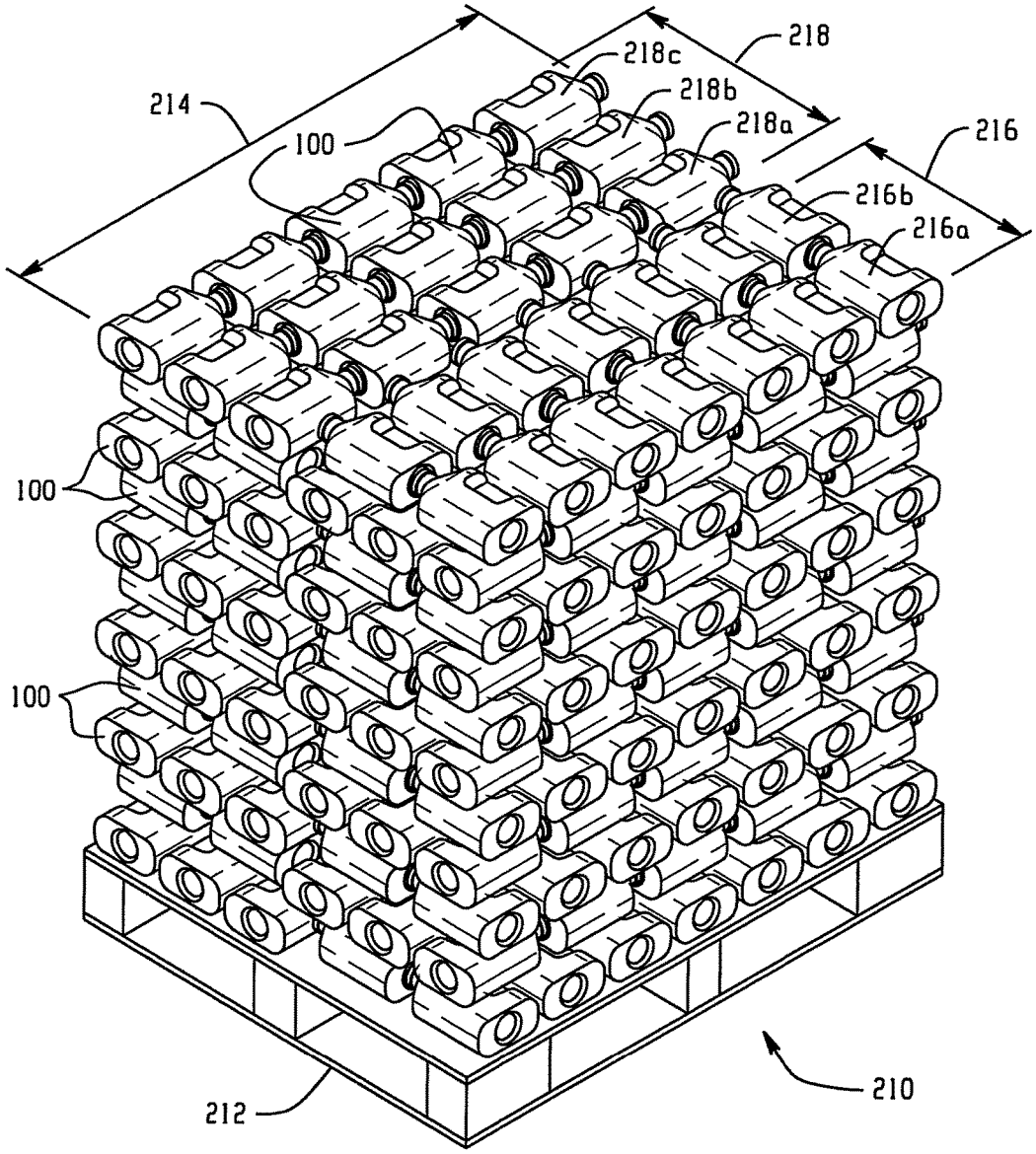
FIG. 9 is a perspective view of filled, like bottles shown in the stacked array on a shipping member such as a pallet.
Figure 10:
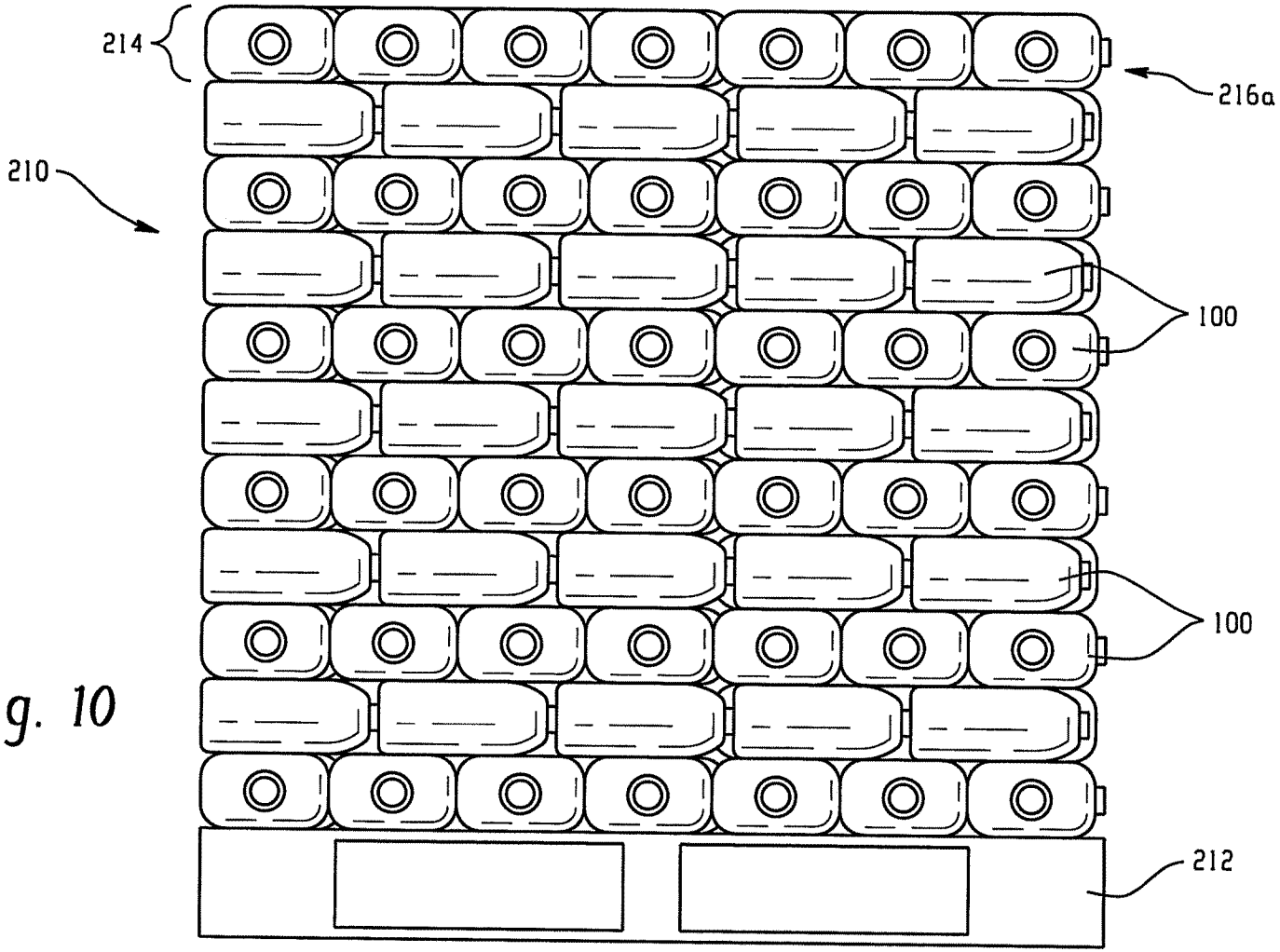
FIG. 10 is an elevational view of the stacked array of FIG. 9.

The opening 180, and more particularly the cap 190 received thereon, defines the uppermost portion of a filled bottle 100. Since the cap 190 has a relatively small surface area, and because the remainder of the upper wall 110 drops away from the central opening 180 and merges into the respective sidewalls 102, 104, 106, 108, this design of the bottle is not conducive to stacking bottles one atop the other in a vertical orientation to transfer load from an upper row of bottles to a lower row of bottles (or to a pallet). However, the contour of the sidewalls 104, 108, and the generally enlarged planar regions 140, 142 of the first and third sidewalls 102, 106, respectively, allows the filled bottles to be positioned in a stacked array and conveniently shipped in such a stacked form 210 on, for example, a pallet 212 (FIGS. 9-10). The above-described contours of the bottles provide for interlock between adjacent bottle bottles in a row or layer of the stacked array.

Figure 7:
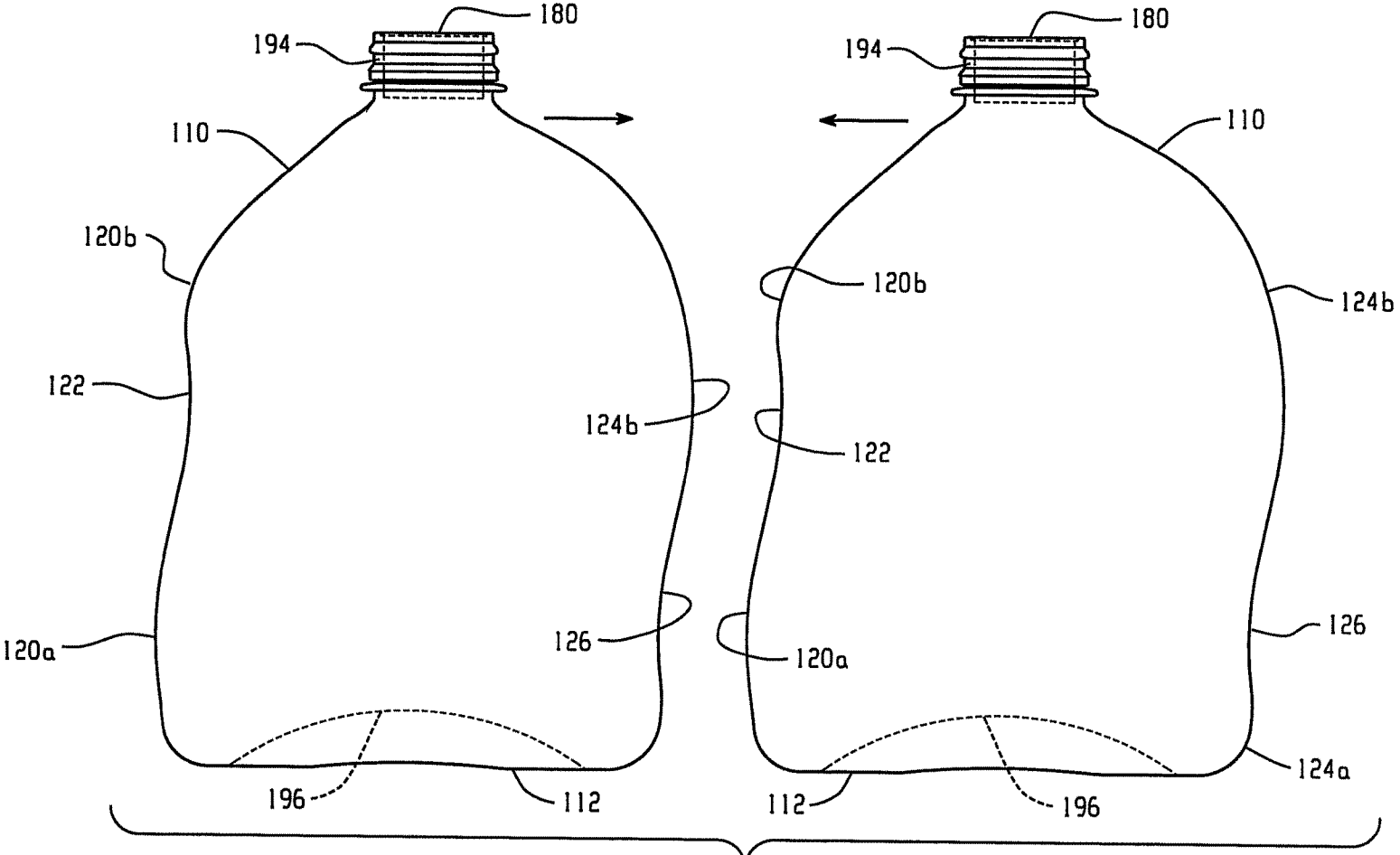
FIG. 7 is a view of first and second bottles shown in side-by-side relation and illustrating the mating contour of opposite sides of adjacent bottles that limits relative sliding movement in a first direction between abutting bottles in a layer of a stacked array.

Particularly, as shown in FIG. 7, adjacent bottles are stacked on the same sidewall, namely either the first or third sidewall 102, 106. The convex surface portion 124*b* of the left-hand bottle in FIG. 7 is received in the concave surface portion 122 of the right-hand bottle. Likewise, the convex portion 120*a* of the right-hand bottle is received in the concave surface portion 126 of the left-hand bottle. The bottles are moved toward one another until they are brought into abutting or substantially abutting relation. The respective concave and convex surface portions interlock one bottle to an adjacent bottle and limits relative sliding movement therebetween in a generally planar direction generally extending between the upper and lower surfaces 110, 112 when the bottles are laid on their sides as shown in FIGS. 9-11.

Figure 8:
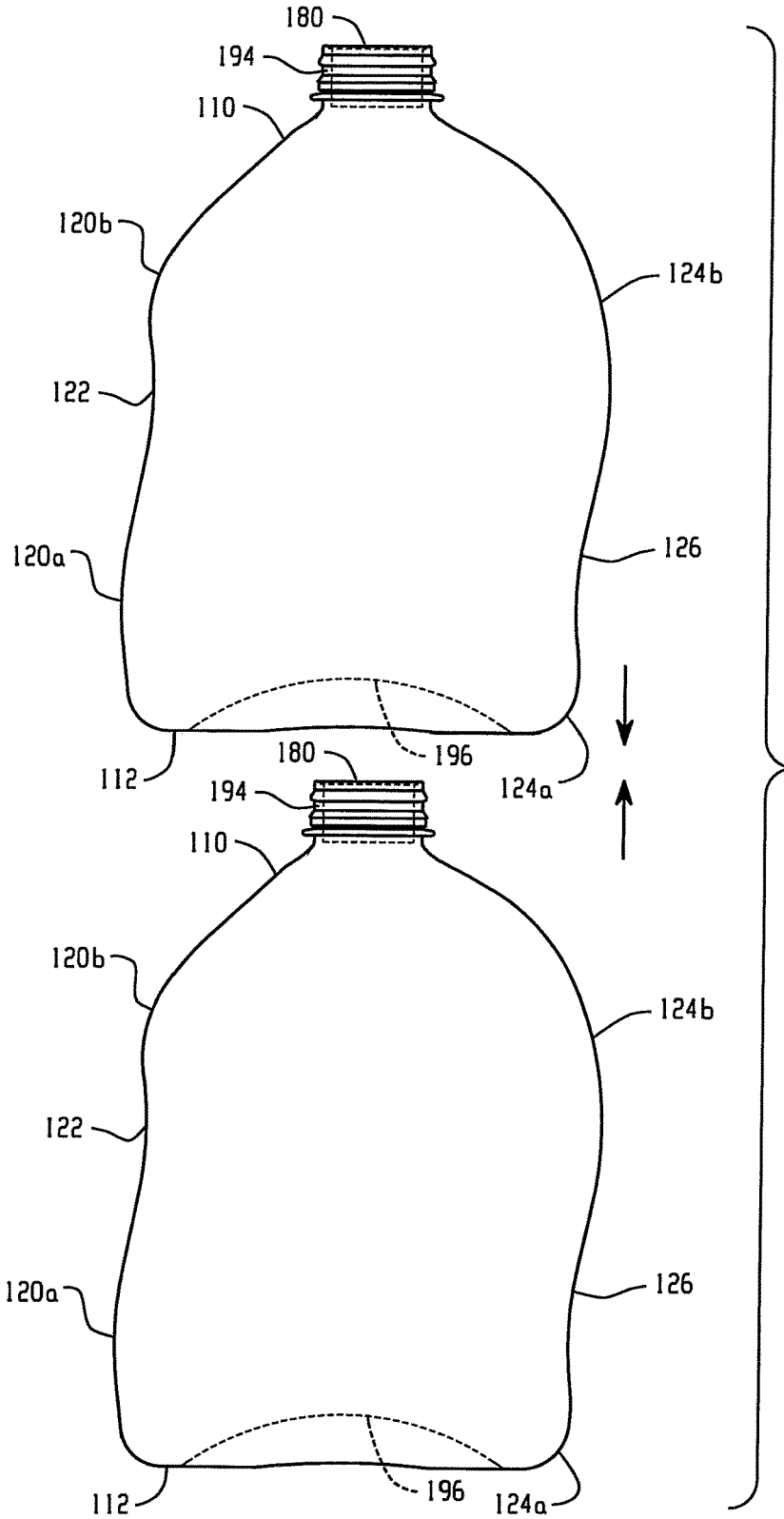
FIG. 8 is a view of the first and second bottles shown in the stacked array and illustrating the mating contour of adjacent bottles that limits relative sliding movement in a second direction between abutting bottles in the layer.

Further, the intercooperation between the cap 190/opening 180 of the upper surface 110 of one bottle with a recess 196 in the lower surface 112 of an adjacent bottle shows a second manner of interlocking adjacent bottles together to prevent relative sliding movement therebetween (again, when the bottles are laid on their sides, and layers of interlocked bottles are stacked one layer atop another (FIGS. 9-11), although the sliding movement is along a direction generally extending between the second and fourth sidewalls of the bottles. As shown in FIG. 8, the opening 180/cap 190 of one bottle is at least partially received within the recess 196 of the adjacent bottle.

Figure 11:
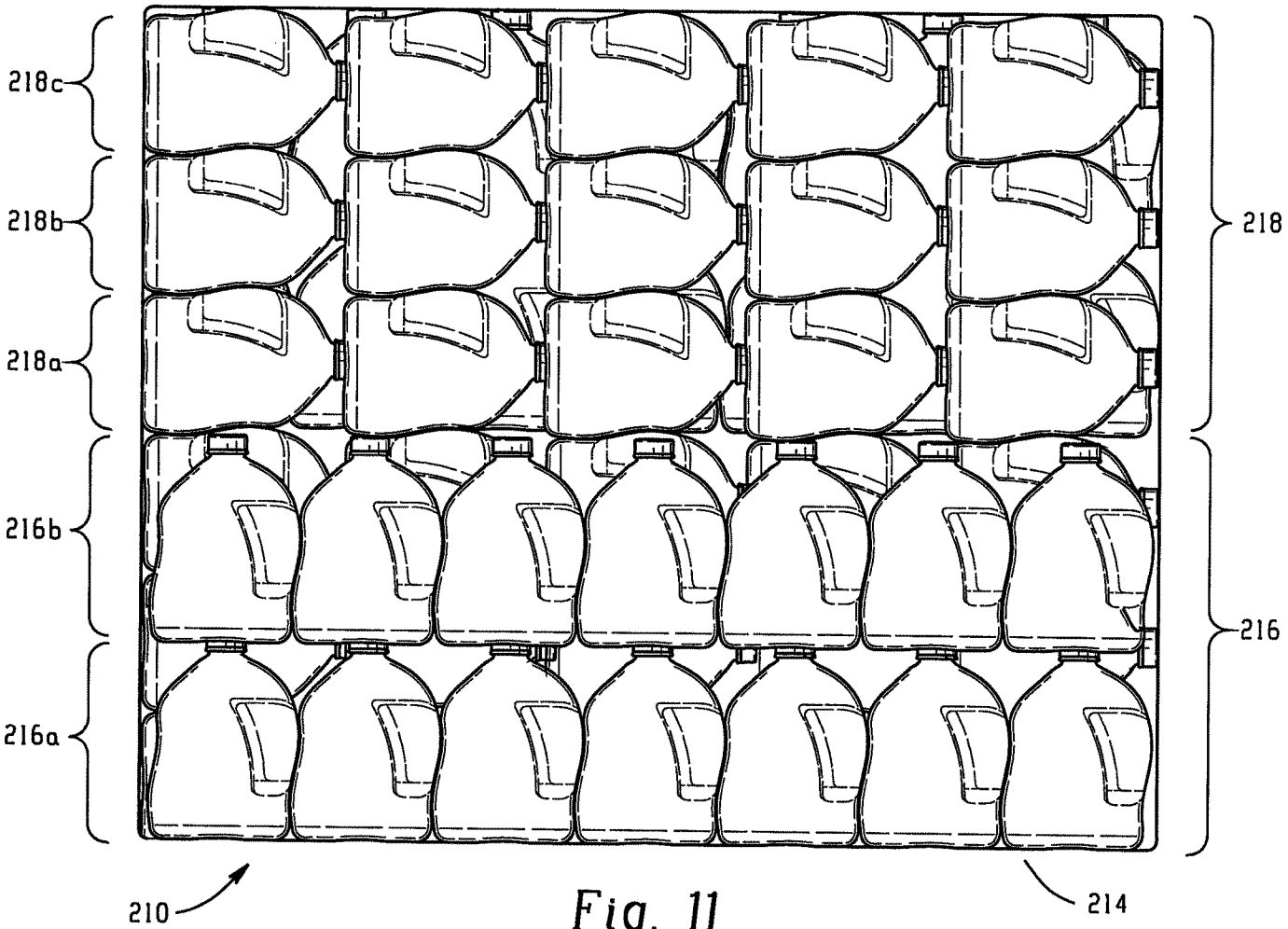
FIG. 11 is a plan view of the stacked array of FIG. 9.

With continued reference to FIGS. 7-8, and additional reference to FIGS. 9-11, the benefits of the contoured bottles are shown in a stacked array 210 on pallet 212. Each of the bottles is filled (preferably under pressure, e.g., about 0.5 psi) and laid on one of the first and third sidewalls 102, 106 of the bottle. By way of example, and with reference to the uppermost layer 214 of the stacked array 210, fourteen filled bottles are oriented in the same direction to form two rows 216 of seven bottles each. Locking between contiguous second and fourth sidewalls 104, 108 of adjacent bottles 100, respectively, is achieved by orienting each of these bottles in the same direction in the layer. Further, the openings 180/caps 190 of the bottles 100 in the first row 216*a* are received in respective recesses 196 in the bottles of the 216*b* to further lock the bottles in these two rows against relative sliding movement. Three rows 218 of filled bottles 100 are laid on one of the first and third sidewalls 102, 106 of the bottle. Fifteen filled bottles 100 are oriented in the same direction to form three rows 218*a*, 218*b*, 218*c* of five bottles each. As is evident in FIGS. 9-11, the bottles 100 in rows 216*a*, 216*b* are rotated 90° relative to the bottles in rows 218*a*, 218*b*, 218*c*. Locking between contiguous second and fourth sidewalls 104, 108 of adjacent bottles 100 is achieved by orienting each of these bottles in the same direction in the layer. The openings 180/caps 190 of the bottles 100 in the first row 216*a* are received in respective recesses 196 in the bottles of the 216*b* to lock the bottles in these two rows against relative sliding movement. In addition, the openings 180/caps 190 of the bottles 100 in row 216*b* abut against the sidewalls 150 of the bottles in row 218*a*. As a result, greater stability is provided in each layer since each bottle 100 is locked against relative movement in two, perpendicular directions within the plane of the layer via interengagement with adjacent bottles. As is also evident in FIGS. 9-11, alternating layers of the stacked arrangement are preferably rotated 90° relative to one another. This, too, adds further stability to the stacked array 210. Although eleven layers of pressurized, filled bottles are illustrated in the stacked array 210, one skilled in the art will appreciate that a greater or lesser number of individual bottles in each row, in each layer, and total bottles in the stacked array may be used without departing from the scope and intent of the present disclosure.

Figure 12:
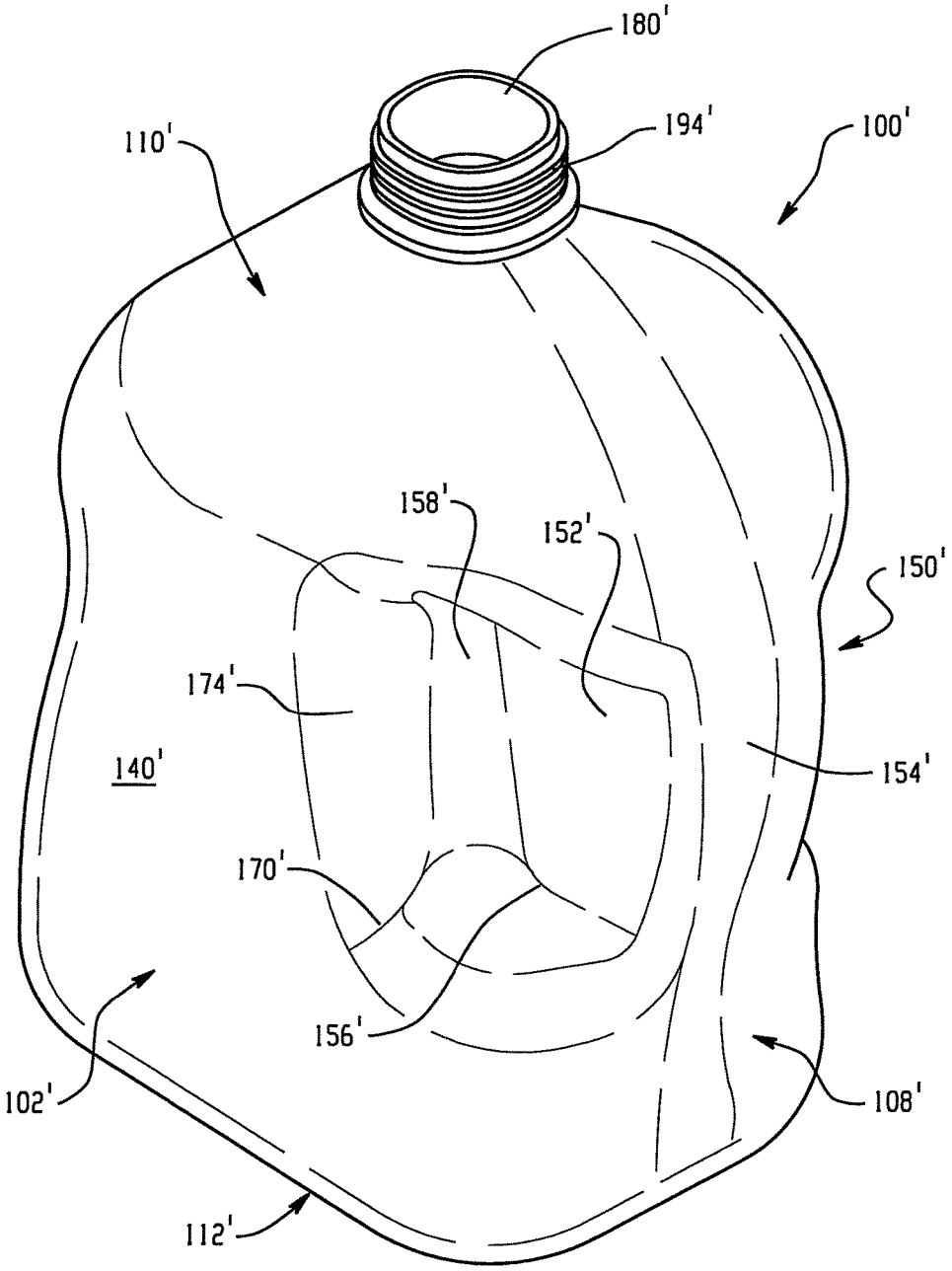
FIG. 12 is a perspective view of a bottle having similar attributes of the bottle of FIG. 1 but a larger volume.
Figure 13:
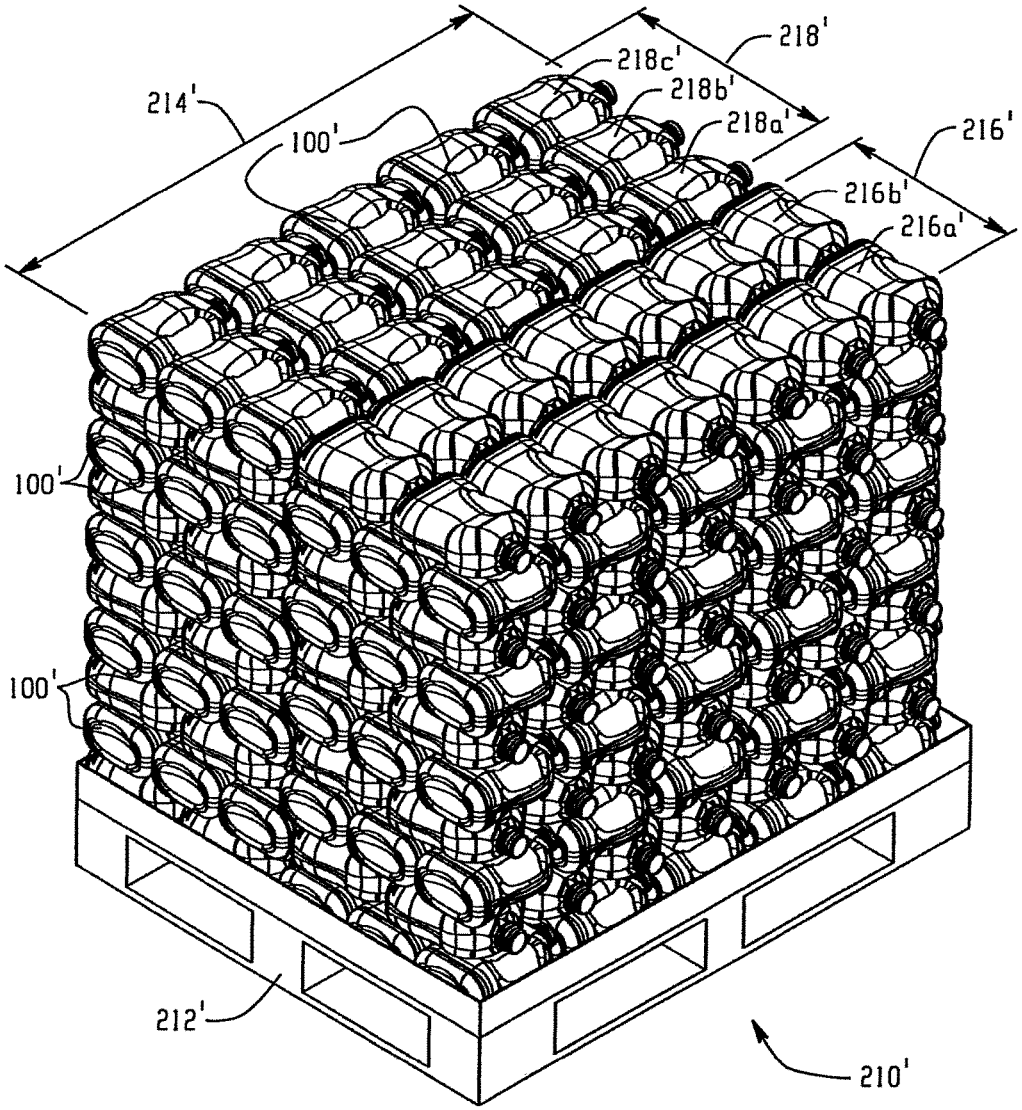
FIG. 13 is a perspective view of filled, like bottles of FIG. 12 shown in the stacked array on a shipping member such as a pallet.
Figure 14:
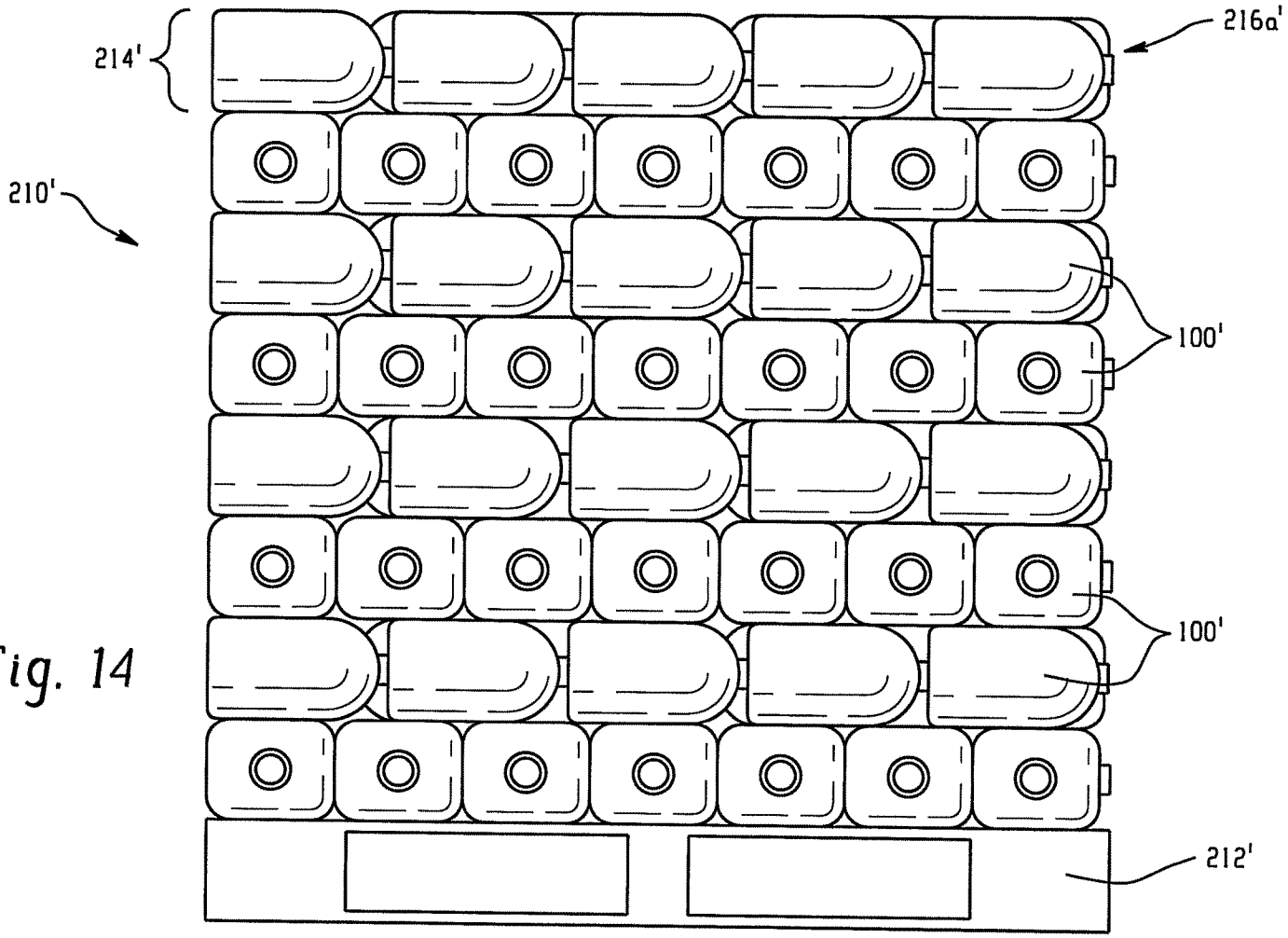
FIG. 14 is an elevational view of the stacked array of FIG. 13.

FIGS. 12-14 illustrate that the features of the first embodiment of FIGS. 1-11 may be incorporated into different volume bottles. Like reference numerals are used to refer to like components with a primed suffix (e.g., bottle 100 in FIGS. 1-11 is now referred to as bottle 100'). By way of example, the fluid volume stored in each bottle 100 in the embodiment of FIGS. 1-11 may be 96 ounces. In the illustrated stacked array 210, there are twenty-nine bottles 100' in each layer, and eleven layers stacked on the pallet for a total of three hundred nineteen bottles (which is 239.25 total gallons). In the embodiment of FIGS. 12-14, the fluid volume in each bottle 100' is one hundred twenty-eight ounces, there are again twenty-nine bottles in each layer but only eight total layers stacked on the pallet. As a result, the stacked array 210' has a total of two hundred thirty-two bottles (which is a total of two hundred thirty-two gallons).

By orienting the bottle on their sides in the stacked orientation, each bottle layer has a sort unbraced length which provides desired increased strength and stability to the individual bottles and to the stacked array.

In summary, the present disclosure provides a unique bottle that includes a center pour opening. This location of the pour opening advantageously meets with user expectation, and what users are acclimated to. The center pour opening also allows the plastic blow molded bottle to be filled on a traditional filler which can further reduce costs. The configuration of the bottle allows like bottles to be easily stacked together. The contoured profiles of adjacent bottles interlock to prevent relative sliding movement between abutting bottles in at least one direction, and preferably two directions that are perpendicular to one another. An enlarged substantially planar region is provided on at least two of the sidewalls to accommodate an enlarged label area desired for marketing and consumer information. The ergonomic handle preferably has a no pass handle for lower manufacturing cost. The handle is also particularly applicable for use as a pressure vessel and the contoured handle easily adapts to lock in the hand of a user while providing a comfortable fit. The bottle can also be scaled-up and scaled-down to accommodate different fluid volumes. The locking features between adjacent bottles by interfitting contiguous, abutting surfaces in the stacked array results in a tied pallet for added strength. Further, the bottle contours and the ability to pressurize the fluid content of the bottles also adds additional strength. The interlocking contours tie the pallet together and remove the need for slip sheets (e.g., corrugate sheet that it typically included in the stacked array to add stability). Elimination of the slip sheets/corrugate layer reduces cost associated both with the material itself, waste, and the handling/labor associated with use of a slip layer. Moreover, it is known that the slip sheet/corrugate layer loses strength if wet-which is a distinct possibility when handling fluid product. As a result of the interlocking contours of the pressurized bottles that are laid on their sides in a stacked array, when the perimeter of the stacked array is wrapped, for example with a plastic shrinkwrap, the pallet with the stacked array of pressurized fluid bottles has desired strength and stability for stacking, shipping, and distribution. Removal of the wrap from the stacked array also does not impact the ability for the stacked array to maintain its shape and stability when consumers remove individual bottles. It will also be appreciated that the drawings should be evaluated together so that features omitted or included in one drawing and not in another drawing, do not preclude use of such features in one drawing from being used with the features in another drawing. For example, structural details of the handle are removed from FIGS. 3, 7, and 8 for ease of illustration. Still another advantage associated with stacking of the bottles on their sidewall is that the unbraced length of the bottle (measured as the height between the first and third sidewalls) is substantially less in comparison to stacking bottles in a vertical orientation which has an elongated unbraced length (measured as the height between the upper wall and the lower wall). A shorter unbraced length likewise adds strength and rigidity to the stacked array.

In a preferred embodiment, the bottle has dimensions as follows: the bottle is about 9.5 inches tall (measured between the upper wall 110 and the lower wall 112) and has a width of 4 inches (measured between the first and third sidewalls 102, 106), and a length of about 6.5 inches (measured between the front and rear sidewalls 104, 108). This computes to an unbraced length-to-height value of 2.375 (9.5 inches divided by 4 inches), and such length-to-height value is preferred to be about 2.5 or less.

Moreover, the plastic bottle is a thin wall structure that has only 90 grams of plastic used in a 96 ounce container, i.e., a low weight-to-volume ratio (e.g., uses only 90 grams of PET for a 96 ounce container—less than 0.94 g/oz) which is approximately one-third the weight-to-volume ratio found in other plastic containers used in the market. Because the container of the present disclosure is pressurized (about 0.5 psi), and the containers are stacked on their sides (a short unbraced length), effective stacking on pallets is still achieved along with desired stability provided by the mating surfaces of the adjacent containers that interlock the bottles. Further, the corrugate/cardboard slip sheets provided between layers of stacked product is also advantageously eliminated because of the interlocked arrangement, all at a cost savings associated with material, labor, and associated waste.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A container for fluid product comprising:

a one piece body having first, second, third, and fourth sidewalls, an upper surface and a lower surface wherein the upper surface is laterally offset from the lower surface, the first and third sidewalls separated by the second and fourth sidewalls, the second and fourth sidewalls having non-planar, parallel conformations that each include a convex surface portion that merges into an adjacent concave surface portion;

wherein when a plurality of adjacent containers are arranged in layers, the layers stacked one atop another by laying individual containers on either the first or third sidewalls where at least two laterally adjacent containers in the same layer interlock along abutting second and fourth sidewalls, and at least two longitudinally adjacent containers in the same layer interlock along the upper and lower surfaces; and wherein at least some of the individual containers in contiguous layers are oriented 90 degrees relative to one another in a first direction, and at least some of the individual containers in the same layer are oriented 90 degrees relative to one another in the first direction.

2. The container of claim 1 wherein the containers in a stacked array are each pressurized.

3. The container of claim 1 further comprising a handle formed at least in part by a cylindrical portion that is dimensioned to conform to a generally C-shape contour formed by a user's thumb and index finger when the fingers of a user's hand are stretched and shaped over a virtual hemispherical surface, wherein the circumferential region of the cylindrical portion of the handle that tangentially merges into the fourth sidewall is located in that portion of the fourth sidewall that has a convex contour.

4. The container of claim 1 wherein at least two laterally adjacent containers in the same layer interlock along respective abutting second and fourth sidewalls in the first direction.

5. The container of claim 4 wherein at least two longitudinally adjacent containers in the same layer interlock along respective upper and lower surfaces in the first direction.

6. The container of claim 4 wherein the upper surface of the container has a center pour opening or cap received in a recessed region of a first adjacent container; or the lower surface has a recessed region dimensioned to receive a center pour opening or cap of a second adjacent container.

7. The container of claim 1 wherein the convex surface portion and the concave surface portion on the second sidewall are opposite from the concave surface portion and the convex surface portion on the fourth sidewall, respectively, whereby adjacent, like containers interlock against relative sliding movement in a direction oriented between the upper and lower surfaces.

8. A container for fluid product comprising:

a one piece body having first, second, third, and fourth sidewalls, an upper surface and a lower surface, wherein the upper surface is laterally offset from the lower surface, the first and third sidewalls separated by the second and fourth sidewalls, the second and fourth sidewalls having non-planar, parallel conformations that each include a convex surface portion that merges into an adjacent concave surface portion;

a handle formed at least in part by a cylindrical portion, and wherein a circumferential region of the cylindrical portion of the handle merges tangentially into the fourth sidewall;

wherein when a plurality of adjacent containers are arranged in layers, the layers stacked one atop another by laying individual containers on either the first or third sidewalls where at least two laterally adjacent containers in the same layer interlock along abutting second and fourth sidewalls, and at least two longitudinally adjacent containers in the same layer interlock along the upper and lower surfaces; and wherein at least some of the individual containers in contiguous layers are oriented 90 degrees relative to one another in a first direction, and at least some of the individual containers in the same layer are oriented 90 degrees relative to one another in the first direction.

9. The container of claim 8 wherein the convex surface portion and the concave surface portion on the second sidewall are opposite from the concave surface portion and the convex surface portion on the fourth sidewall, respectively, whereby adjacent, like containers interlock against relative sliding movement in a direction oriented between the upper and lower surfaces.

10. The container of claim 9 wherein the circumferential region of the cylindrical portion of the handle that tangentially merges into the fourth sidewall is located in that portion of the fourth sidewall that has a convex contour.

11. The container of claim 8 wherein at least two laterally adjacent containers in the same layer interlock along respective abutting second and fourth sidewalls in the first direction.

12. The container of claim 11 wherein at least two longitudinally adjacent containers in the same layer interlock along respective upper and lower surfaces in the first direction.

13. The container of claim 11 wherein the upper surface of the container has a center pour opening or cap received in a recessed region of a first adjacent container; or the lower surface has a recessed region dimensioned to receive a center pour opening or cap of a second adjacent container.

* * * * *